US005161351A

United States Patent [19]

Woodruff

[11] Patent Number: 5,161,351

[45] Date of Patent: Nov. 10, 1992

[54] ANIMAL HARNESS SAFETY BUCKLING

[76] Inventor: Dale K. Woodruff, 5638 Bellaire, Fresno, Calif. 93707

[21] Appl. No.: 639,135

[22] Filed: Jan. 9, 1991

[51] Int. Cl.[5] ..... A45F 5/08; A44B 1/04

[52] U.S. Cl. ..... 54/6.1; 24/191; 24/170

[58] Field of Search ..... 54/6 R, 6 A, 24; 24/170, 191, 311, 68 CD

[56] References Cited

U.S. PATENT DOCUMENTS

| | | | |
|---|---|---|---|
| 342,110 | 5/1886 | Kjellstrom | 24/170 |
| 906,391 | 12/1908 | Dickson et al. | 24/170 |
| 1,797,653 | 3/1931 | Gross | 24/191 X |
| 2,496,891 | 2/1950 | Preszler | 24/170 |
| 2,816,339 | 12/1957 | Prete, Jr. et al. | 24/170 |
| 3,013,317 | 12/1961 | Weber | 24/170 X |
| 3,458,971 | 8/1969 | Stern et al. | 54/6 R |
| 3,872,554 | 3/1975 | Wolfertz et al. | 24/191 X |

FOREIGN PATENT DOCUMENTS

| | | | |
|---|---|---|---|
| 623155 | 3/1927 | France | 24/191 |
| 330808 | 6/1930 | United Kingdom | 24/191 |

*Primary Examiner*—Gene Mancene
*Assistant Examiner*—Nicholas D. Lucchesi
*Attorney, Agent, or Firm*—Wells, St. John, Roberts, Gregory & Matkin

[57] ABSTRACT

A harness 10 includes a buckle 20 for releasably securing harness strap ends 13 and 14 in one of two alternative conditions. The buckle includes a frame 21 and a pivoted clasp member 37. One strap end 13 is secured to the buckle frame. The other strap end 14 may be connected through an opening 38 between the clasp member 37 and a clamping surface 26 on the frame. The clasp 37 is normally held closed by a spring 46, operating against an eccentric clamp surface 42 on the clasp member 37. Alternatively, a spring arm of the spring 46 may be lifted, and the free end of the strap end 14 may be inserted through the buckle between the clasp member 37 and the spring arm. When released against the strap, the spring arm will hold the strap for release upon application of prescribed tension along the straps. The clasp member is mounted to the frame within angular slots to permit opening of the clasp to accept thick straps or straps of double thickness.

13 Claims, 3 Drawing Sheets 40
48
47
51
50
47
49
46
48
20
41
39
37
42
45
34
25
21
32
33
22
29
23
34
28
26
32
25
33
45

ANIMAL HARNESS SAFETY BUCKLING

TECHNICAL FIELD

The present invention relates to animal harness and safety buckling to permit selective secure fastening or selective release of animal harness strap ends.

BACKGROUND OF THE INVENTION

Many animals, especially horses, are fitted with harnesses, even when at pasture. The harness gives the capability of a point of attachment for a lead rope or other connection device and eliminates the need to place a loop about the animal's neck. Harnesses, however, are not without certain drawbacks.

A particular concern is placing an animal with a harness in a corral or other area where there is a possibility that the harness might become caught on some stationery object such as a fence post. When this happens, and the incident goes undetected, strangulation or other trauma to the animal may result. This is due to the fact that most conventional harnesses are supplied with standard buckles for the harness strap ends that permit only secure fastening of the ends and secure attachment of the harness to the animal's head and neck area.

The above problem was realized to a limited degree in U.S. Pat. No. 4,376,366 to Miller. This patent discloses a safety harness for horses. It includes buckles with tongues that are fitted through aligned holes in the strap. The device further includes a spring clip connecting one strap end to one of the buckles. Opposed ends of the spring clip fit within recesses in the buckle and are intended to pull free of the buckle once a prescribed amount of tension is applied to the harness straps. The device is relatively complex, involving two separate "tongue" type buckles. The tongues of the buckles may be selectively secured through holes and the headstall strap in order to firmly secure the harness in place. No reasonable amount of tension will then cause the buckles to release the straps.

If it is desired to place the Miller harness in condition for release on a prescribed amount of tension applied to the headstall, one of the tongues must be removed from the strap to leave the spring release element connecting the headstall in the loop about the animal's head. Excessive tension applied to the headstall will then allow the ends of the spring clip to disengage and open the headstall loop.

The Miller release mechanism is functional only when one of the two buckles is unfastened. When both buckles are fastened in the secure position no release function is possible. Further, to disconnect the buckles, additional tension must be applied to the strap ends before the tongues can be pulled free of the strap openings. Thus, if the animal becomes entangled while the headstall is in the closed, secure condition with both buckles in operation, extreme difficulty may be experienced in disconnecting the straps to relieve the tension. Thus, the same difficulty is experienced when the strap is in the closed secure condition (with both buckles fastened) as is experienced with a harness having conventional tongue type buckle straps.

It has therefore remained a problem to provide a harness arrangement for animals with a single buckle including safety features to facilitate quick and easy release of the harness strap members when (a) the buckle is secured to firmly hold the harness straps, or (b) the buckle releasably secures the straps together to facilitate separation of the straps should the harness become entangled with some anchored object, such as a fence post.

BRIEF DESCRIPTION OF THE DRAWINGS

A preferred form of the present invention is illustrated in the accompanying drawings in which.

DETAILED DESCRIPTION OF THE PREFERRED EMBODIMENT

This disclosure of the invention is submitted in furtherance of the constitutional purposes of the Patent Laws "to promote the progress of science and useful arts" (Article 1, Section 8).

Figure 1:
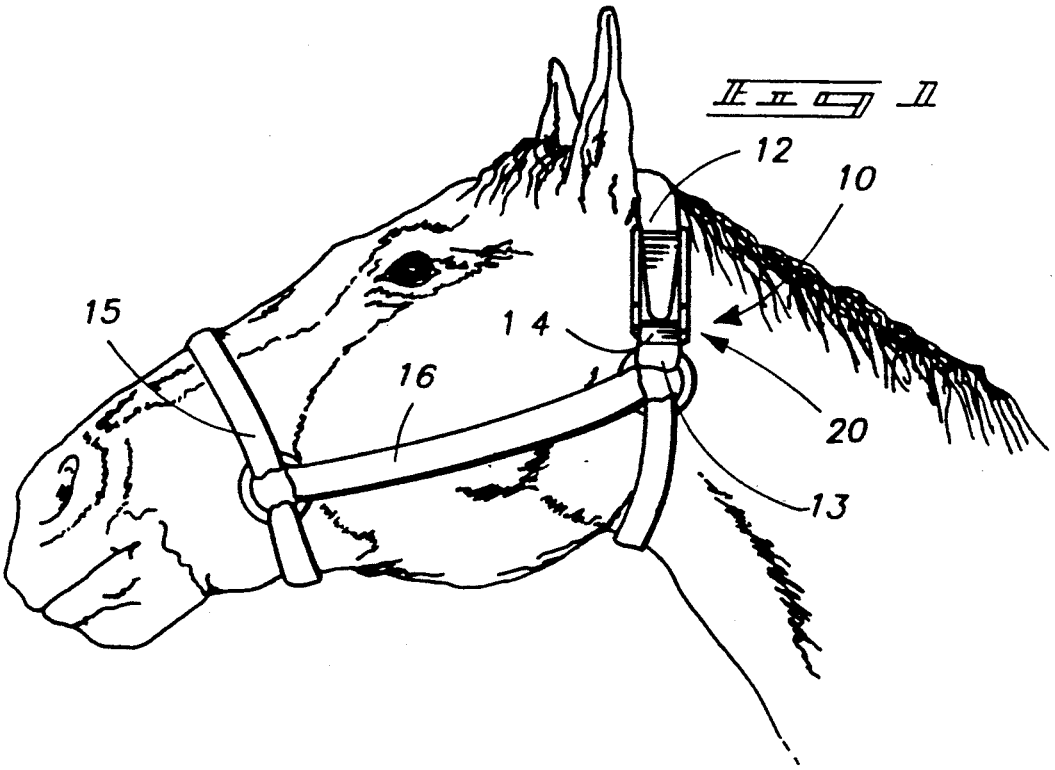
FIG. 1 is a view of a harness incorporating the present invention.

An animal harness in combination with the present safety buckling features is generally shown in FIG. 1 by the reference numeral 10. It should be understood that the harness 10 as shown, though primarily useful for horses, may also be adapted for use on other animals. Likewise, the present buckle arrangement may also be utilized in connection with other forms of animal harness than that exemplified in FIG. 1.

The harness 10 includes a strap or straps 11 forming a nose band 15, a cheek piece 16 and a headstall 12. The strap 11 includes ends 13, 14 that may be secured together by the present buckle which is shown at 20.

The harness 10 and the straps 11 comprising the harness may be constructed of numerous materials. In a preferred form, the strap materials may be a woven synthetic strapping such as nylon that is wear resistant, flexible and comfortable for the animal. Such strapping is commonly used in the tack manufacturing industries. Leather strapping may also be used.

Figure 3:
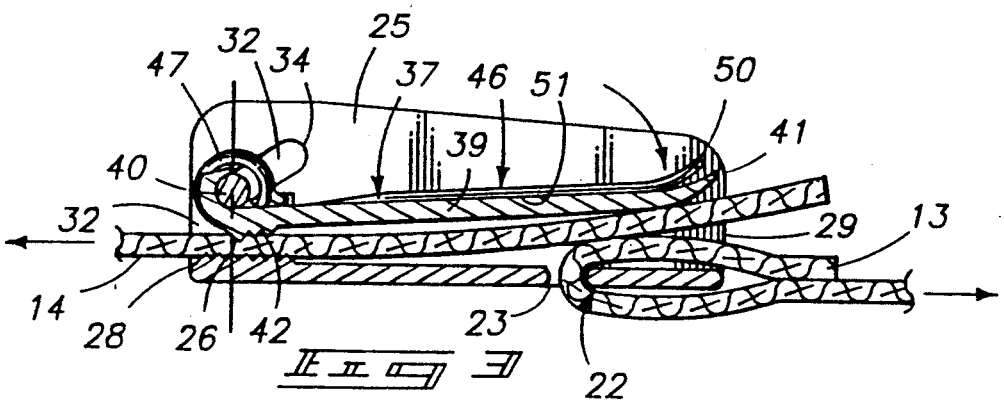
FIG. 3 is a sectional view taken substantially along line 3—3 in FIG. 2.
Figure 5:
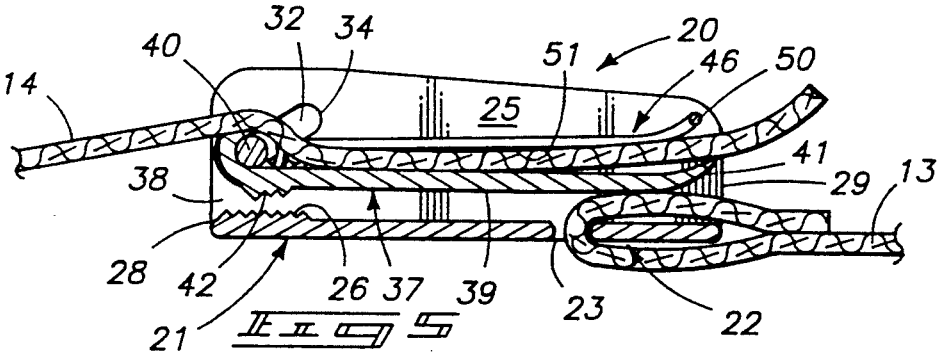
FIG. 5 is a sectional view taken substantially along line 5—5 in FIG. 4.

The buckle 20 includes important features of the present invention that facilitate selective joining of the strap ends 13 and 14. The single buckle 20 enables selective joining of the strap ends 13, 14 (a) in a secure condition in which the straps are locked together against separation as shown in FIG. 3, or (b) in a selectively releasable condition as shown in FIG. 5 where a selected amount of tension may be applied to the straps to cause separation thereof. Elements of the buckle will be described below which facilitate these functions.

The buckle 20 includes a rigid frame 21. The frame 21 includes upturned frame sides 25 to opposite sides of a first upwardly facing clamp surface 26. The sides 25 may be integral with the frame and formed simply by bending the frame sides upwardly using appropriate stamping or press forming technology. The frame is preferably formed of a single sheet of metal such as mild steel or, if desired, stainless steel.

The frame 21 includes a strap mounting means 22 for securing the strap end 13. The mounting means 22 is simply comprised of a slot 23 formed through the frame 21 to mount the strap end which may be threaded through the slot 23 and attached to itself as by sewing, adhesive, etc. The strap end 13 is therefore substantially permanently affixed to the frame 21.

The frame 21 extends between a forward end 28 and a rearward end 29 adjacent the slot 23. The sides 25 likewise extend between the ends 28, 29 and define a strap receiving passageway along the full length of the frame.

The first clamp surface 26 is formed along the frame 21 toward the forward frame end 28. The clamp surface 26 is advantageously textured as by knurling or other texture forming technology to afford a gripping surface to one side of a strap end 14 received along the frame length.

Each of the upturned frame sides 25 in the preferred form, includes an angular slot 32. The slots 32 may be punched or formed by other conventional means through the thickness dimension of the frame sides 25. Slots 32 are substantially parallel to one another and extend from forward ends 33 that are spaced by first distance from the first clamp surface 26, to rearward ends 34 which are spaced by distances greater than the first distance from the surface 26.

Figure 6:
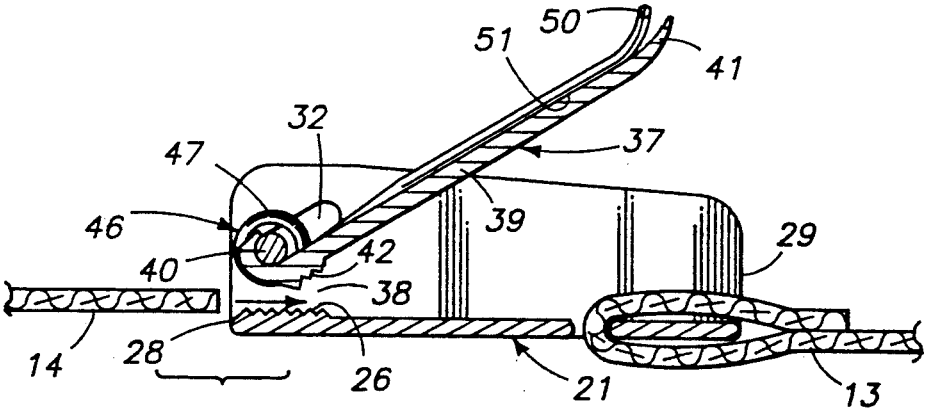
FIG. 6 is a sectional view illustrating insertion of a harness strap into the present buckle.

Buckle 20 also includes a clasp member 37. The clasp member 37 is mounted to the frame and forms a harness strap receiving opening 38 between itself and the first clamp surface 26. The clasp member 37 is movable on the frame between an open condition (FIG. 6) to allow passage of the harness strap end 14 through the opening 38; and a closed condition (FIG. 3) in which the opening 38 is at least partially closed to securely clamp the harness clamp end 14 to the frame.

The clasp member 37 is comprised of a rigid plate 39. The plate 39 is secured at one end to a pivot pin 40. Opposed ends of the pivot pin 40 are pivotably and slidably received within the angular slots 32. The slots 32 hold the axis of the pin substantially parallel to the first clamp surface 26.

The plate 39 is upturned at its remote end (opposite the end mounting pivot pin 40) to allow finger access to manually move the plate between open (FIG. 6) and closed condition (FIG. 3).

The clasp member further includes a second clamp surface means 42 thereon. Surface means 42 is operable, responsive to selective pivotal motion of the clasp member 37 to the closed position, to close the opening and securely clamp the harness strap to the frame as may be noted in FIG. 3. Likewise, surface means 42 will release the clamping pressure responsive to movement of the plate to the upward open position.

There is a particular geometry of the pivot pin axis, the first clamp surface 26, and the second clamp surface 42 that should be noted. In referring to FIG. 3, it may be noted that the second clamp surface means 42 is spaced rearwardly of the axis shown extending through the center of the pivot pin 40 and which is aligned perpendicularly to the first clamp surface 26. Thus, the second clamp surface means 42 is offset rearwardly from a dead center relationship along this axis. Because of this relationship, any tension that may be applied along the strap 14 as shown in FIG. 3 by the directional arrows, will result in downward pivotal motion of the clasp member 37. Such tension correspondingly causes the clamp surfaces to move closer together and more securely clamp the strap in position within the buckle.

This is true at any position of the pin along the length of the angular slots 32. The slots 32 are provided simply to facilitate reception of the straps having different thickness dimensions. In fact, two straps may be received within the opening 38, if desired. Referring to FIG. 3, tension applied to the straps 13, 14 in the direction of the arrows will urge corresponding longitudinal motion of the clasp within the slots 32 toward the forward slot ends 33. The angled slots 32 will cause the clasp member to move toward the first clamp surface 26, and apply additional clamping force to the secured strap 14.

A spring means 46 is supplied with the buckle 20 and is connected to the clasp member 37 and frame 21 for yieldably biasing the clasp member to the closed condition. Spring means 46 is comprised of coiled steel spring in the form generally shown in FIG. 8.

Figure 8:
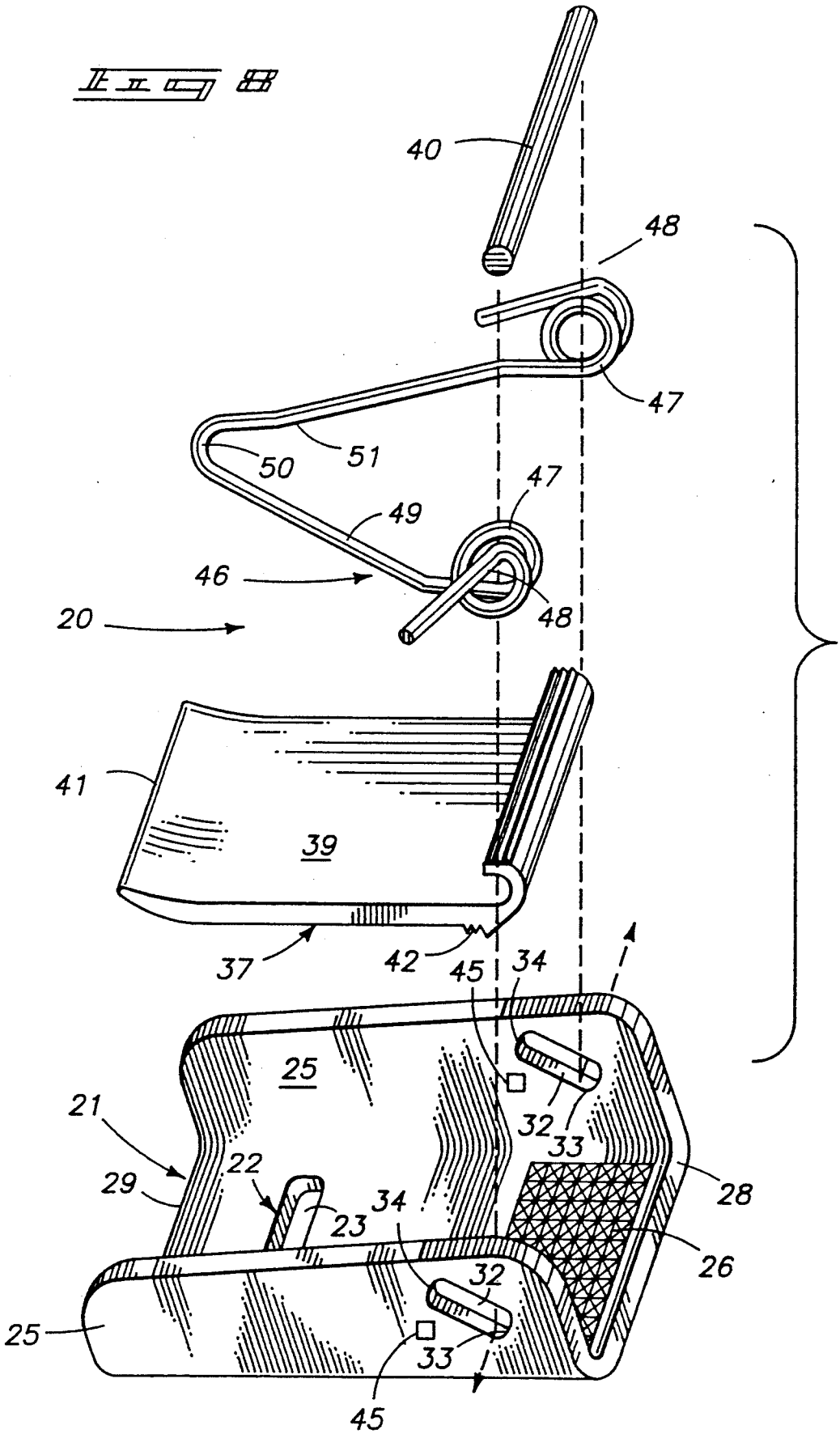
FIG. 8 is an exploded pictorial view of the components for the present buckle.

The spring 46 includes opposed torsion coils 47 that are loosely received over opposed ends of the pivot pin 40. Ends of the coils 47 are connected to the frame 21 by provision of appropriate slots or holes 45 as shown in FIG. 8.

An integral spring arm 49 extends rearwardly from the torsion coils 47. A spring arm 49 is substantially "v"-shaped with its apex or pointed end 50 turned upwardly. The spring arm 49 is normally yieldably engaged against the rigid plate 39 in order to bias the plate 39 toward the closed condition.

Figure 4:
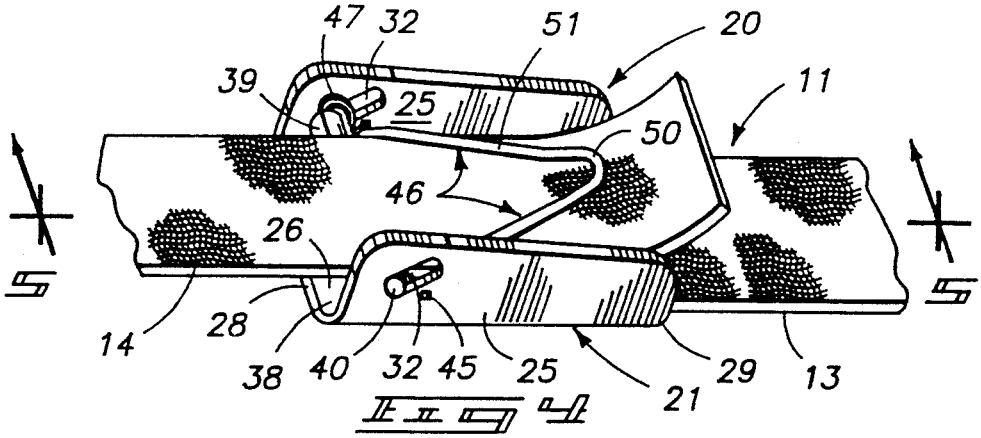
FIG. 4 is a pictorial view similar to FIG. 2 only showing the harness straps and the present buckle in a releasable condition.
Figure 7:
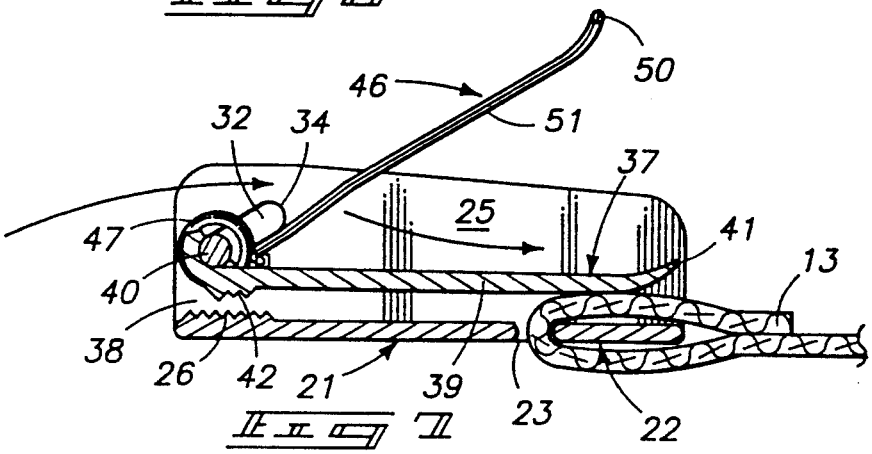
FIG. 7 is a view illustrating passage of a harness strap into the buckle to be releasably secured as shown in FIG. 5.

The spring arm may be manually moved to an open condition either with the plate or separate from the plate 39 as shown in FIG. 7. This facilitates insertion of the strap end 14 between the spring arm 49 and clasp 37 as shown by the arrows in FIG. 7 to be releasably clamped as shown in FIGS. 4 and 5.

The spring arm 49 includes a third clamp surface means 51. Surface 51 is formed integrally along the bottom side surface of the spring arm 49. Surface 51 is useful to clasp or frictionally press against the received strap.

It is noted that the clasping forces applied by surface 51 are nothing more than the torsion spring force applied by the spring coils to press the strap 14 against the smooth upper surface of the rigid plate 39. The surfaces on the top of the plate 39 allow clamping of the strap to facilitate a safety release feature as an alternative to the firm clamping engagement shown in FIGS. 2 and 3.

If the present harness 10 is to be used on an animal while the animal is free, say within a corral area, the user may wish to connect the harness in a safety condition. This is done simply by lifting the spring arm 49 to the position shown in FIG. 7 and by inserting the strap end 14 between the spring arm and the rigid plate 39 of the clasp member 37. The spring arm may then be released to clamp the received strap 14 against the clasp member 38 substantially as shown in FIGS. 4 and 5.

The clamping force between the spring arm and the clasp member is sufficient to hold the harness in position about the animal's head. However, should the animal hook the harness on a stationery object, such as a fence post, tension applied by the animal along the lengths of the straps 13, 14 will overcome the grip of the spring arm and clasp and allow the straps to separate. The straps will therefore release before the animal becomes endangered or injured.

Figure 2:
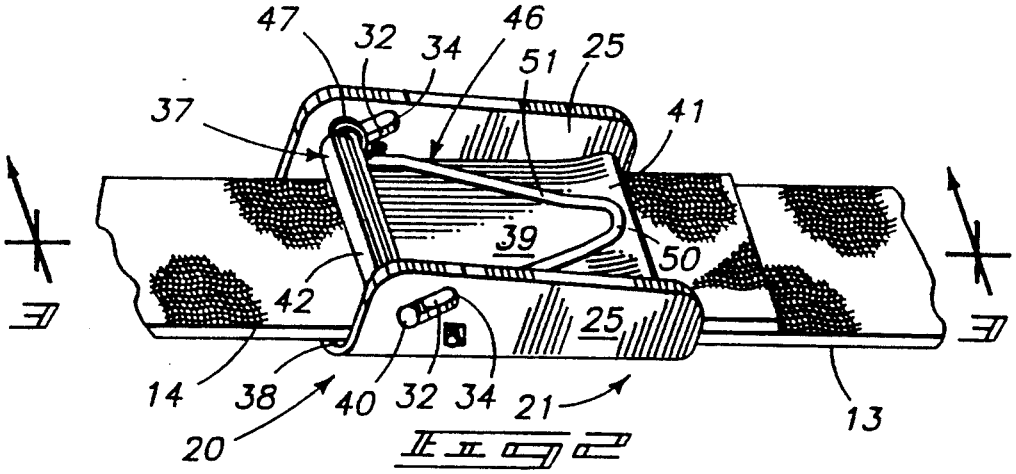
FIG. 2 is a fragmented view of harness straps with the present buckle mounted thereon in a secure, clamped condition.

If the user wishes to secure the harness in a more stable condition, as when the animal is being controlled by connection of the harness to a leash, etc., the user may wish to secure the harness ends in the condition shown in FIGS. 2 and 3. In so doing, the clasp member 37 is lifted to the open condition shown in FIG. 6 and the end 14 is inserted through the harness end receiving opening 38. Once the free end 14 is passed through the opening 38, the user may release the clasp member 37 and allow the spring to return the clasp to the closed, clamping position as shown in FIG. 3.

Should the user wish the strap to be tighter, the strap 14 may be grasped toward the rearward side of the frame and pulled. The strap will slide only against slight spring resistance of the clasp through the buckle until the desired tension is applied. The free end may then be released and the clasp member will be cammed toward the clamping orientation, securely holding the harness ends together.

If additional forces are applied in the direction of the arrows shown in FIG. 3, the effect will be additional clamping pressure applied due to the geometry of the clamping surface 26, pivot axis for pin 40, and the orientation of the second clamp surface means 42. The strap ends will therefore be held firmly together.

When it is desired to release the strap ends, such may be done easily, regardless of the amount of tension applied to the straps. The ends are released simply by lifting the clasp member 37 to the upwardly open condition shown in FIG. 6. The clasp may be easily released due to the mechanical advantage applied about the pivot axis for pin 40 against the second clamp surface means 42. A slight upward force as applied at the upwardly turned end 41 of plate 39 will result in a significantly large upward lifting force against the second clamp surface means 42, causing disengagement with the strap end 14, regardless of the amount of tension placed on the strap. This is a distinct advantage over prior release arrangements where additional tension must be applied to disengage the typical hook and eye buckle arrangement before the straps can be released.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. An animal harness safety buckle, comprising:

a frame including a first clamp surface;

harness strap mounting means on the frame for attaching the buckle to an animal harness strap;

a clasp member mounted to the frame, forming a harness strap receiving opening with the first clamp surface on the frame and movable on the frame between an open condition allowing passage of a harness strap end between the clasp member and frame, and a closed condition;

second clamp surface means on the clasp member, operable responsive to motion of the clasp member to the closed condition to partially close the harness receiving opening and securely clamp a harness strap received therein to the frame;

spring means connected to the clasp member and frame and including a spring arm extending along and across the clasp member for yieldably biasing the clasp member to the closed condition; and a third clamp surface means on the spring arm, movable with the arm independently of the clasp member to form a passage between the clasp member and the third clamp surface means through the buckle for slidably and releasably receiving any desired length of the harness strap therethrough, and for pressing the harness strap against the clasp member to releasably hold the harness strap to the clasp member.

2. The animal harness safety buckle, as claimed by claim 1, wherein the clasp member is pivotally mounted to the frame about an axis that is substantially parallel to the first clamp surface, and wherein the second clamp surface means is substantially parallel to the first clamp surface and radially offset from the pivot axis.

3. The animal harness safety buckle, as claimed by claim 1, wherein the clasp member is pivotally mounted by a pivot member to the frame about an axis that is substantially parallel to the first clamp surface, and wherein the second clamp surface means is substantially parallel to the first clamp surface and radially offset from the pivot axis; and wherein the frame includes an angular slot receiving the pivot member for sliding and pivotal movement relative to the first clamp surface toward and away from the first clamp surface to facilitate reception of more than one harness strap between the first clamp surface and the second clamp surface means.

4. The animal harness safety buckle, as claimed by claim 1, wherein the clasp member is pivotally mounted by a pivot member to the frame;

wherein the frame includes a forward and a rearward end and further includes an angular slot formed therein between the forward and rearward ends for receiving the pivot member;

wherein the slot includes a forward end spaced from the first clamp surface by a first distance and a rearward end spaced from the first clamp surface by a second distance greater than the first distance to facilitate reception of more than one harness strap between the first clamp surface and the second clamp surface means.

5. The animal harness safety buckle, as claimed by claim 1, wherein the clasp member is pivotally mounted to the frame by a pivot member about an axis that is substantially parallel to the first clamp surface, and wherein the spring means is comprised of a torsion spring mounted to the pivot member and the frame; and wherein the third clamp surface means includes an end of the torsion spring arm releasably engaging the clasp member.

6. The animal harness safety buckle, as claimed by claim 1:

wherein the clasp member is mounted to the frame for pivotal motion thereon by a pivot member;

wherein the frame includes a forward and a rearward end and further includes opposed upturned sides, each with an angular slot formed therein for receiving the pivot member;

wherein the slot includes a forward end spaced from the first clamp surface by a first distance and a rearward end spaceed from the first clamp surface by a second distance greater than the first distance to facilitate reception of more than one harness strap between the first clamp surface and second clamp surface means;

wherein the spring means includes a torsion spring with coils mounted to the pivot member adjacent the upturned sides and the frame; and wherein the spring arm extends along and across the clasp member between the coils of the spring means.

7. The animal harness safety buckle, as claimed by claim 1, wherein the clasp member is pivotally mounted to the frame for movement thereon about a pivot axis between a clamping and a releasing position and wherein the spring arm includes an end forming the third clamp surface means releasably engaging the clasp member and biased by the clasp member toward the clamping position.

8. The animal harness safety buckle, as claimed by claim 1, wherein the second clamp surface means is pivotal on the frame about an axis substantially parallel to the first clamp surface, and is radially spaced from the axis by a distance such that the second clamp surface means is angularly offset from a dead center relationship between the pivot axis and the first clamp surface when a harness strap is received therebetween; and wherein the spring arm extends over the clasp member, with an end forming the third clamp surface means releasably engaging the clasp member and biasing the clasp member toward the dead center position, and yieldably movable relative to the clasp member away from the clasp member.

9. In an animal harness including a headstall and separable headstall strap ends, a safety buckle, comprising:

a frame including a first clamp surface;

harness strap mounting means on the frame attaching the buckle to one of the headstall strap ends;

a clasp member mounted to the frame, forming a receiving opening for a remaining headstall strap end, with the first clamp surface on the frame and movable on the frame between an open condition allowing passage of a remaining headstall strap end between the clasp member and frame, and a closed condition;

second clamp surface means on the clasp member, operable responsive to motion of the clasp member to the closed condition to partially close the harness receiving opening and securely clamp a remaining headstall strap end received therein to the frame;

spring means connected to the clasp member and frame and including a spring arm extending along and across the clasp member for yieldably biasing the clasp member to the closed condition; and a third clamp surface means on the spring arm, movable with the arm independently of the clasp member to form a passage between the clasp member and the third clamp surface means through the buckle for alternatively slidably and releasably receiving any desired length of the headstall strap therethrough, and for and pressing the headstall strap against the clasp member to releasably hold the headstall strap end to the clasp member.

10. In an animal harness including a headstall and separable headstall strap ends, a safety buckle as claimed by claim 9, wherein the clasp member is pivotally mounted to the frame about an axis that is substantially parallel to the first clamp surface, and wherein the second clamp surface means is substantially parallel to the first clamp surface and radially offset from the pivot axis.

11. In an animal harness including a headstall and separable headstall strap ends, a safety buckle as claimed by claim 9:

wherein the clasp member is pivoted on the frame about an axis substantially parallel to the first clamp surface, and the second clamp surface means thereon is radially spaced from the axis by a distance such that the second clamp surface means is angularly offset from a dead center relationship between the pivot axis and the first clamp surface when a remaining headstall strap end is received therebetween; and wherein the spring means includes a spring arm extending over the clasp member, with an end forming the third clamp surface means releasably engaging the clasp member and biasing the clasp member toward the dead center position, and yieldably movable relative to the clasp member away from the clasp member to releasably receive a remaining headstall strap end between the spring arm end and clasp member.

12. In an animal harness including a headstall and separable headstall strap ends, a safety buckle as claimed by claim 9:

wherein the clasp member is mounted to the frame for pivotal motion thereon by a pivot member;

wherein the frame includes a forward and a rearward end and further includes an angular slot formed therein for receiving the pivot member;

wherein the slot includes a forward end spaced from the first clamp surface by a first distance and a rearward end spaceed from the first clamp surface by a second distance greater than the first distance to facilitate reception of more than one remaining headstall strap end between the first clamp surface and the second clamp surface means;

wherein the spring means is comprised of a torsion spring mounted to the pivot member and the frame; and wherein the third clamp surface means is comprised of an end of the torsion spring releasably engaging the clasp member.

13. In an animal harness including a headstall and separable headstall strap ends, a safety buckle as claimed by claim 9, wherein the clasp member is mounted to the frame for pivotal motion thereon by a pivot member;

wherein the frame includes a forward and a rearward end and further includes an angular slot formed therein for receiving the pivot member;

wherein the slot includes a forward end spaced from the first clamp surface by a first distance and a rearward end spaceed from the first clamp surface by a second distance greater than the first distance to facilitate reception of more than one remaining headstall strap end between the first clamp surface and the second clamp surface means;

wherein the spring means includes a spring arm extending over the clasp member, with an end forming the third clamp surface means releasably engaging the clasp member and biasing the clasp member toward the dead center position, and yieldably movable relative to the clasp member away from the clasp member to releasably receive a remaining headstall strap end between the spring arm end and clasp member.

* * * * *